US006899012B2

(12) United States Patent
Pili et al.

(10) Patent No.: US 6,899,012 B2
(45) Date of Patent: May 31, 2005

(54) FLUID FLOW CONTROL VALVE ASSEMBLY WITH INDEPENDENT FEEDBACK PRESSURE

(75) Inventors: Roger R. Pili, Madison, WI (US); Duane D. Dwyer, Milwaukee, WI (US)

(73) Assignee: Actuant Corporation, Glendale, WI (US)

( * ) Notice: Subject to any disclaimer, the term of this patent is extended or adjusted under 35 U.S.C. 154(b) by 21 days.

(21) Appl. No.: 10/442,519

(22) Filed: May 21, 2003

(65) Prior Publication Data

US 2004/0231506 A1 Nov. 25, 2004

(51) Int. Cl.[7] ..... F15B 13/04
(52) U.S. Cl. ..... 91/445; 91/446
(58) Field of Search ..... 91/445, 446, 420

(56) References Cited

U.S. PATENT DOCUMENTS

| | | | | |
|---|---|---|---|---|
| 3,677,295 | A | | 7/1972 | Schultz |
| 3,796,232 | A | | 3/1974 | Dalton |
| 4,210,065 | A | | 7/1980 | Switzer |
| RE30,517 | E | | 2/1981 | McClocklin |
| 4,351,362 | A | | 9/1982 | Solie et al. |
| 4,823,550 | A | | 4/1989 | Decker |
| 4,835,966 | A | * | 6/1989 | Kauss et al. ..... 91/445 |
| 4,964,433 | A | | 10/1990 | Marietta |
| 5,967,285 | A | | 10/1999 | Mohan et al. |

FOREIGN PATENT DOCUMENTS

JP 55-51103 4/1980

OTHER PUBLICATIONS

Patent Abstracts of Japan, vol. 0040, No. 94 (M–019), Jul. 8, 1980 (English translation of JP 55–51103).

* cited by examiner

*Primary Examiner*—Edward K. Look
*Assistant Examiner*—Michael Leslie
(74) *Attorney, Agent, or Firm*—Quarles & Brady LLP

(57) ABSTRACT

A fluid flow control valve assembly that can be actuated using an electrically operated or pneumatically operated flow control valve includes a valve body having a fluid supply passageway, a fluid exhaust passageway, and a fluid bypass passageway. A pilot operated relief valve is disposed in the fluid bypass passageway, wherein the pilot operated relief valve blocks the fluid bypass passageway to create a pressure upstream of the pilot operated relief valve to actuate a different pilot operated device having a pilot line in fluid communication with the fluid bypass passageway upstream of the pilot operated relief valve. Fluid flowing through a venturi nozzle in the fluid bypass passageway that intersects the fluid exhaust passageway lowers the pressure in the fluid exhaust passageway.

18 Claims, 7 Drawing Sheets

FLUID FLOW CONTROL VALVE ASSEMBLY WITH INDEPENDENT FEEDBACK PRESSURE

CROSS REFERENCES TO RELATED APPLICATIONS

Not Applicable

STATEMENT REGARDING FEDERALLY SPONSORED RESEARCH

Not Applicable

BACKGROUND OF THE INVENTION

The invention relates to control valves, and more particularly to fluid flow control valve assembly with independent feedback pressure.

Fluid flow control valve assemblies are commonly used for controlling the flow of fluid, such as hydraulic fluid, air, and the like, into and out of cylinders to extend and retract a ram. The control valve assemblies typically include a fluid supply passageway that supplies fluid to the cylinder and a fluid exhaust passageway that exhaust fluid from the cylinder. A multi-position valve can be provided that controls the flow of fluid through the passageways.

A known fluid flow control valve assembly for operating a single acting cylinder is disclosed in U.S. Pat. No. 4,823,550. The control valve assembly includes a manually operable rotary multi-position flow control valve that controls the flow of fluid through a fluid supply passageway and a fluid exhaust passageway formed through a valve block. A fluid bypass passageway formed in the control block includes a venturi nozzle. The fluid exhaust passageway intersects the fluid bypass passageway downstream of a venturi nozzle, such that fluid is quickly drawn out of the cylinder by fluid pumped through the venturi nozzle.

The manually operable rotary multi-position flow control valve controls the flow of fluid through the passageways in the valve block, and has three positions: a load position, a hold position, and an unload position. In the load position, fluid is pumped through the control valve into the cylinder. In the hold position, the control valve blocks all flow into and out of the cylinder. Finally, in the unload position, the control valve directs fluid through the venturi nozzle and allows fluid to flow out of the cylinder. In one embodiment, disclosed in the patent, a check valve that blocks fluid flowing out of the cylinder opens in response to fluid directed to the venturi nozzle.

It is often desirable to control a cylinder using an electrically or pneumatically operated flow control valve in cooperation with a pilot operated check valve that can hold fluid in the cylinder with the flow control valve in the reset position. A pilot operated check valve includes a pilot line, and opens in response to a feedback pressure in the pilot line. Unfortunately, the above control valve assembly does not provide a feedback pressure independent of the flow control valve position, and thus cannot be operated using an electrically or pneumatically operated flow control valve in cooperation with a pilot operated check valve that can hold fluid in the cylinder with the flow control valve in the reset position. Therefore, a need exists for a flow control valve assembly that can control a cylinder using an electrically or pneumatically operated flow control valve in cooperation with a pilot operated check valve that can hold fluid in the cylinder with the flow control valve in the reset position.

SUMMARY OF THE INVENTION

The present invention provides a fluid flow control valve assembly that can be actuated using an electrically operated or pneumatically operated flow control valve. The fluid flow control valve assembly includes a valve body having a fluid supply passageway, a fluid exhaust passageway, and a fluid bypass passageway. A pilot operated relief valve is disposed in the fluid bypass passageway, wherein the pilot operated relief valve blocks the fluid bypass passageway to create a pressure upstream of the pilot operated relief valve to actuate a different pilot operated device having a pilot line in fluid communication with the fluid bypass passageway upstream of the pilot operated relief valve. In one embodiment, a venturi nozzle is disposed in the fluid bypass passageway, and has an upstream end and a downstream end, wherein the fluid exhaust passageway intersects the fluid bypass passageway proximal the downstream end of the venturi nozzle such that fluid flowing through the venturi nozzle lowers the pressure in the fluid exhaust passageway.

A general objective of the present invention is to provide a fluid flow control valve assembly that can operate a pilot operated device. This objective is accomplished by providing a pilot operated relief valve that blocks a passageway to create a pressure to operate the pilot operated device.

Another objective of the present invention is to provide a fluid control valve assembly that can quickly draw fluid out of the fluid exhaust passageway. This objective is accomplished by providing a venturi nozzle in a fluid bypass passageway that intersects the fluid exhaust passageway, such that fluid flowing through the venturi nozzle lowers the pressure in the fluid exhaust passageway.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE INVENTION

Figure 1:
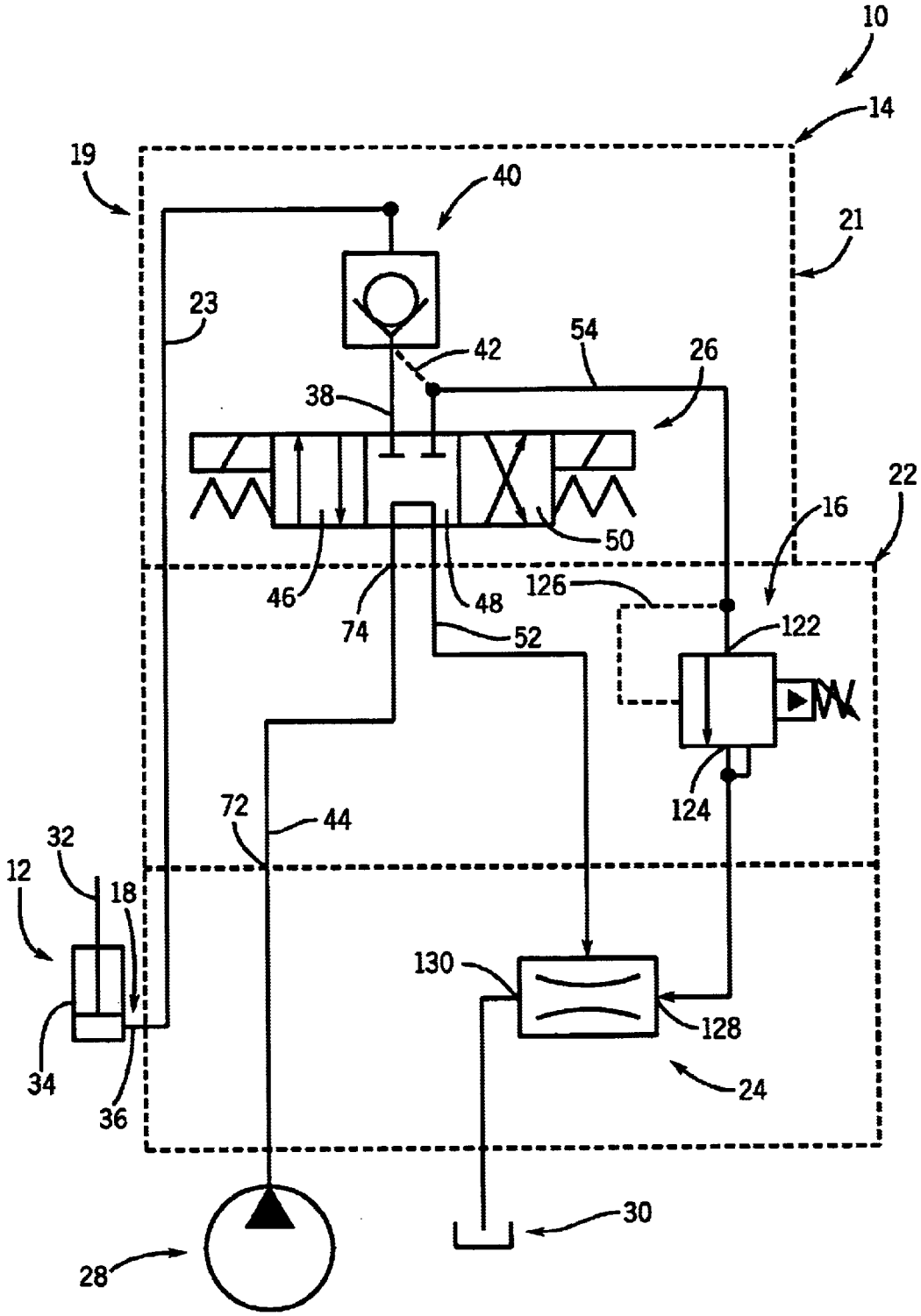
FIG. 1 is a fluid circuit diagram of a control valve assembly incorporating the present invention.
Figure 2:
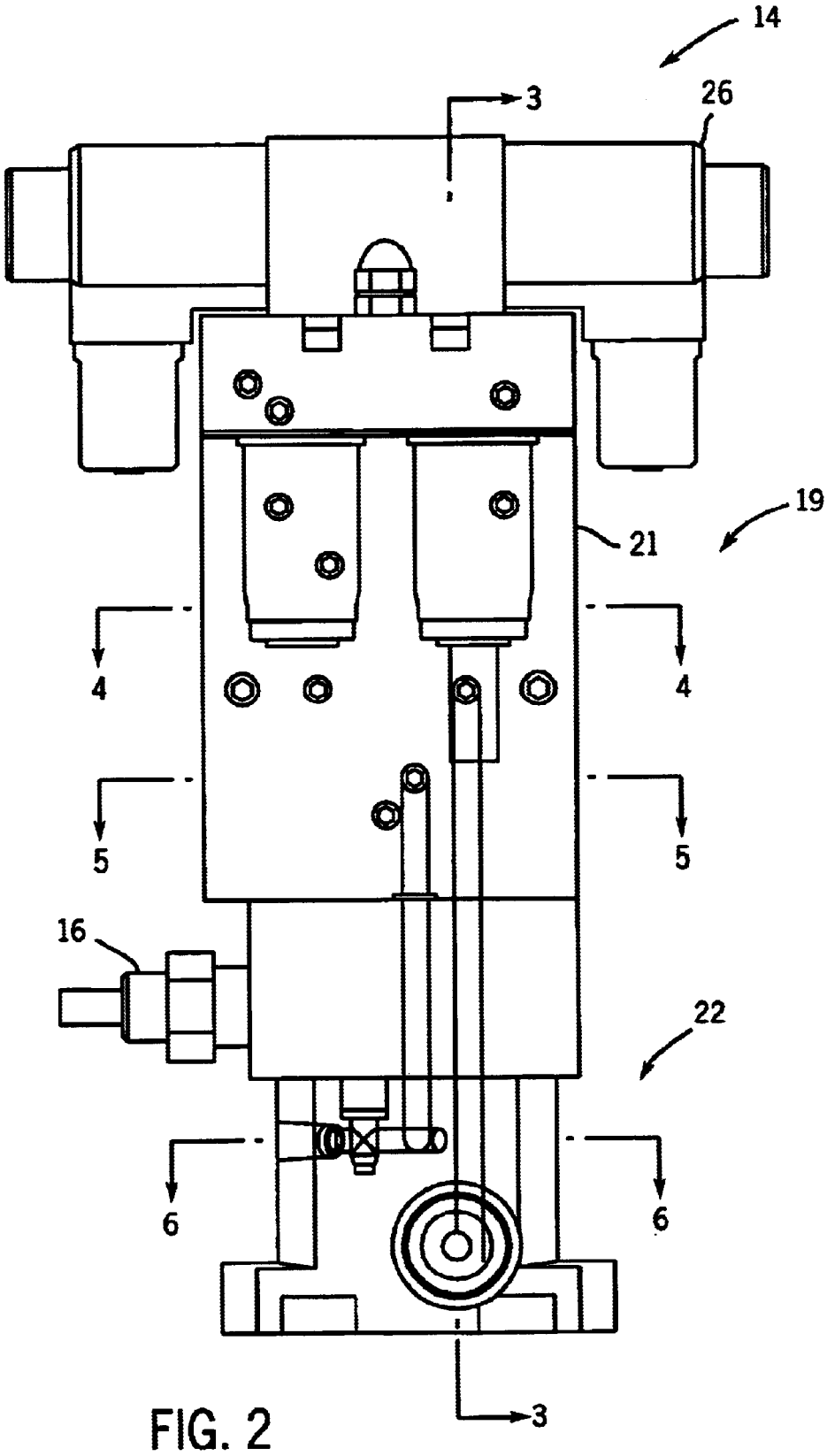
FIG. 2 is a front elevation view of the control valve assembly of FIG. 1.
Figure 3:
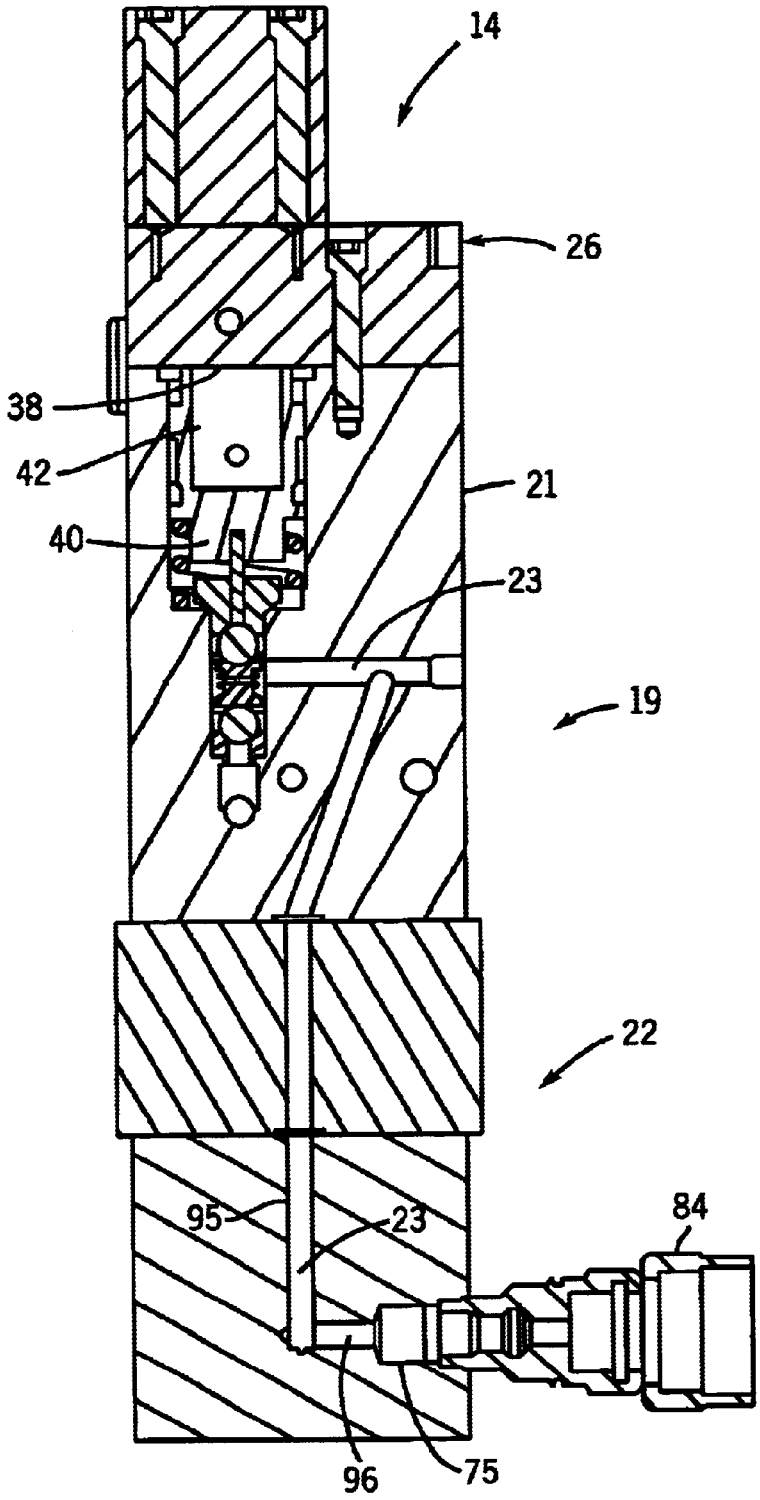
FIG. 3 is a cross sectional view along line 3—3 of FIG. 2.
Figure 4:
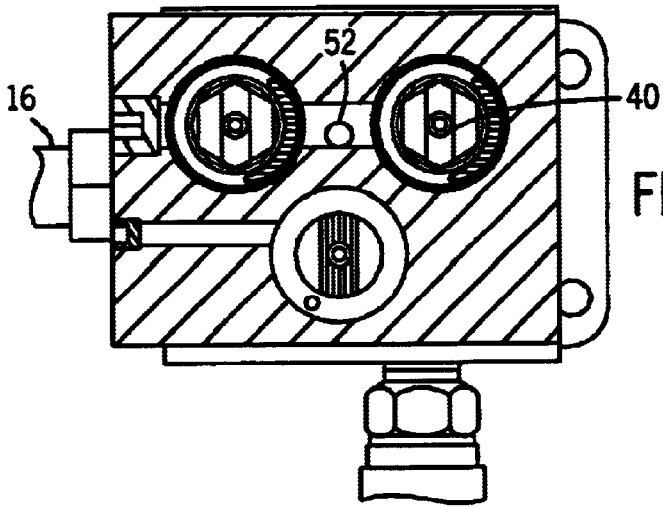
FIG. 4 is a cross sectional view along line 44 of FIG. 2.
Figure 5:
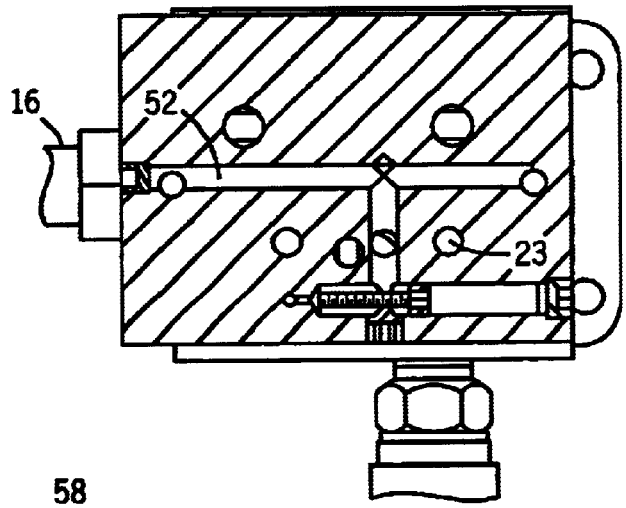
FIG. 5 is a cross sectional view along line 5—5 of FIG. 2.
Figure 6:
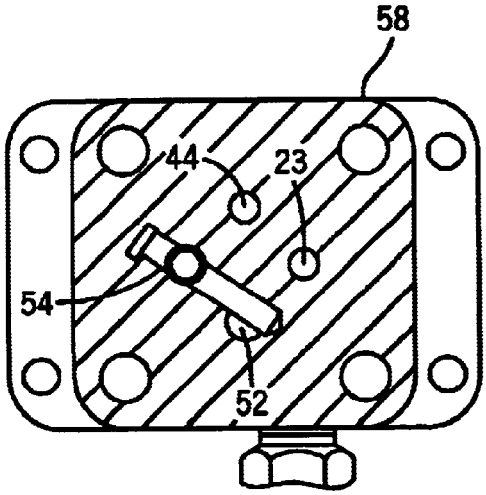
FIG. 6 is a cross sectional view along line 6—6 of FIG. 2.
Figure 7:
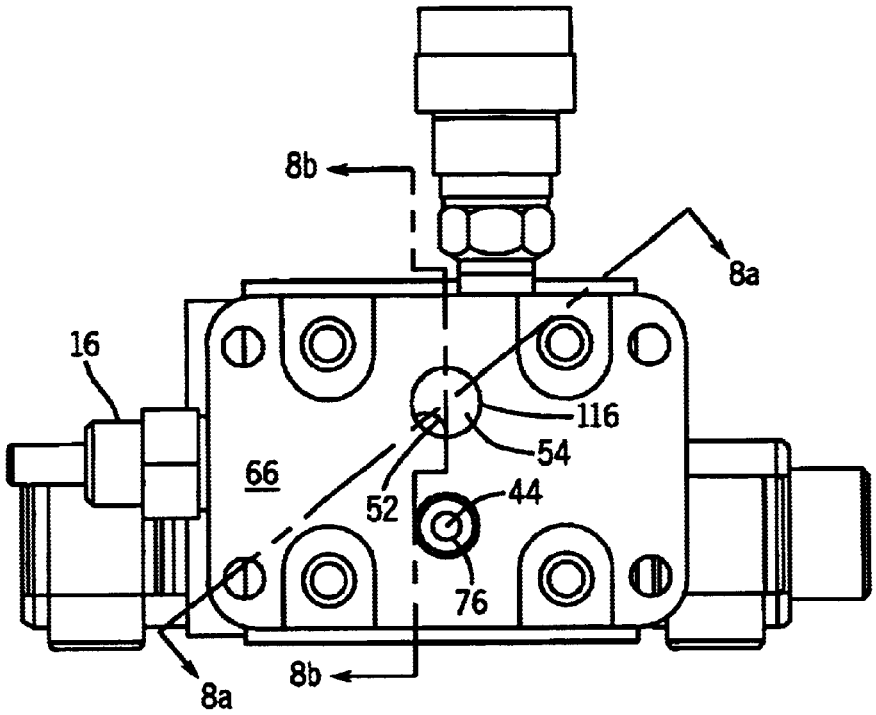
FIG. 7 is a bottom view of the control valve assembly of FIG. 2.
Figure 11:
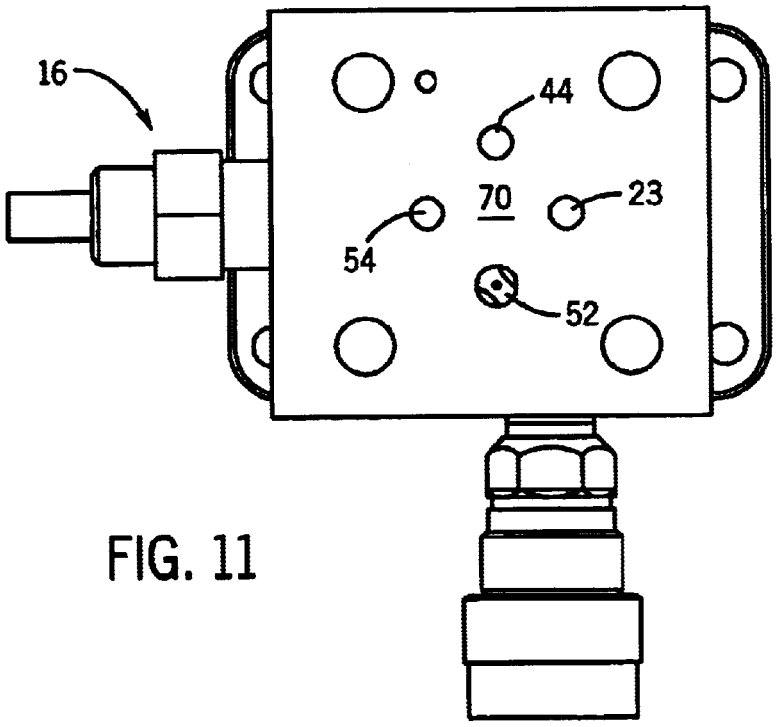
FIG. 11 is a top view of the lower valve block of FIG. 9.
Figure 8A:
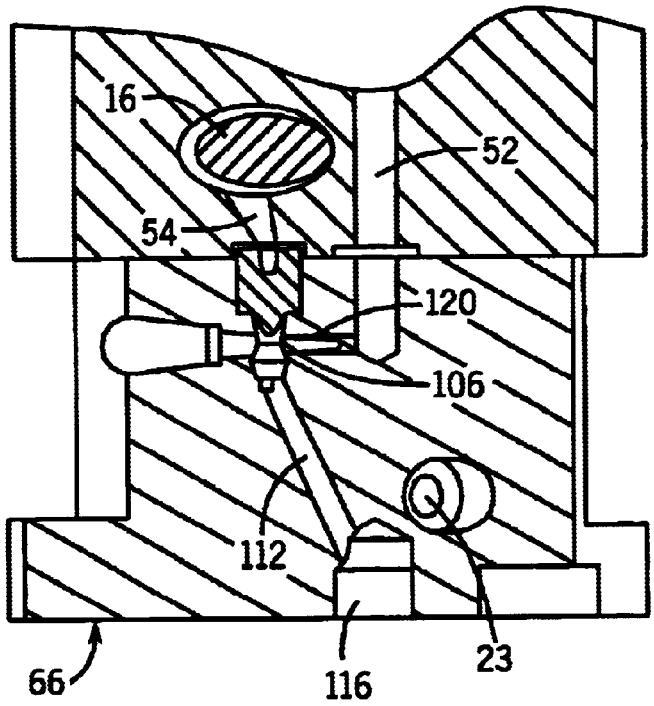
FIG. 8 is a composite cross section view along lines 8*a*—8*a* and 8*b*—8*b;*
Figure 8B:
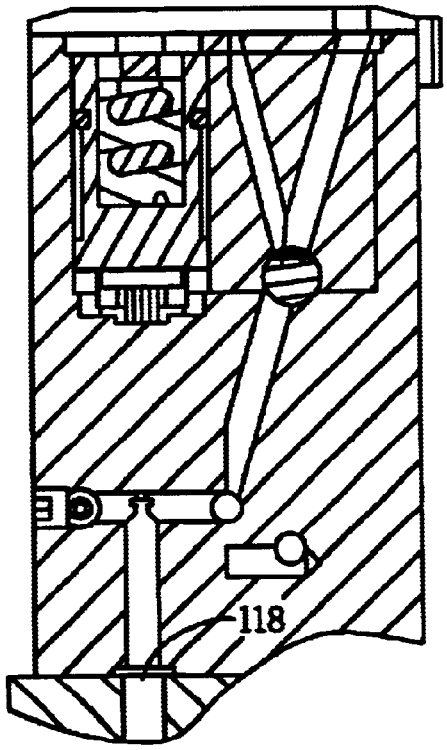
Figure 10:
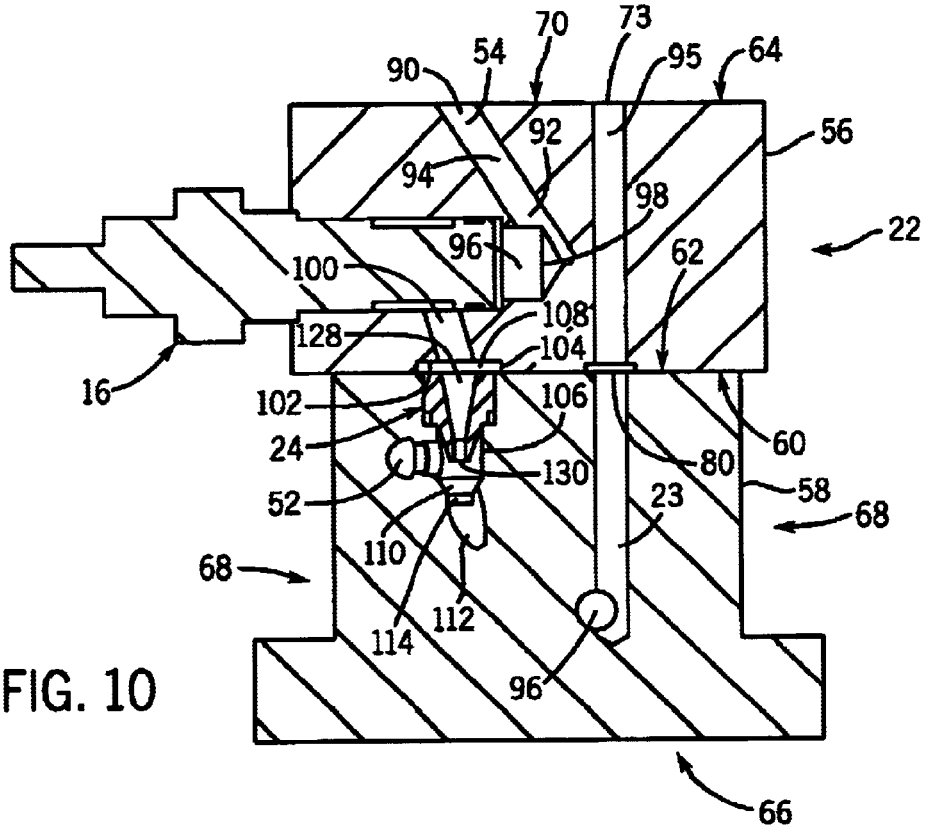
FIG. 10 is a cross sectional view along line 10—10 of FIG. 9.
Figure 9:
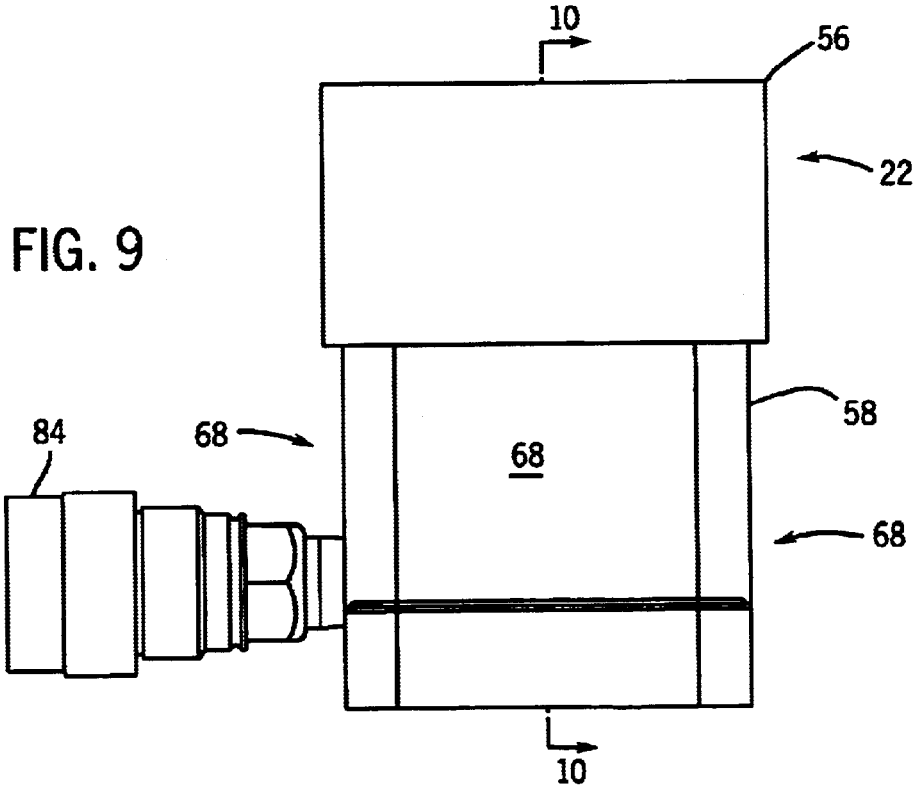
FIG. 9 is a side elevation view of the lower valve block of FIG. 2.

As shown in FIG. 1, a fluid circuit 10 operating a single acting fluid cylinder 12 includes a control valve assembly 14 having a pilot operated relief valve 16 that provides a feedback pressure for controlling the flow of fluid through a supply line 18 exhausting fluid from the cylinder 12. The control valve assembly 14 includes a multi-position flow control valve 26 that directs the fluid into and out of the cylinder 12, and valve block assembly 19 having a venturi nozzle 24 that draws the fluid out of the cylinder 12. A pump 28 in fluid communication with the control valve assembly 14 pumps fluid through the control valve assembly 14 to supply fluid to the cylinder 12 and through the venturi nozzle 24 to draw fluid out of the cylinder 12. The pilot operated relief valve 16 blocks fluid flow through the control valve assembly 14 to provide a feedback pressure independent of the multi-position flow control valve 26.

The pump 28 supplies fluid to the cylinder 12 through the control valve assembly 14, and includes an intake (not shown) in fluid communication with a reservoir 30 containing a fluid, such as hydraulic fluid, air, and the like. The fluid is drawn from the reservoir 30 through the pump intake and expelled by the pump 28 through an exhaust port into the control valve assembly 14. The pump 28 can be any type pump known in the art, such as a piston pump, centrifugal pump, and the like.

The single acting fluid cylinder 12 can be any cylinder known in the art, such as hydraulic or pneumatic cylinder, having a ram 32 slidably received in a housing 34. The cylinder 12 is actuated by pumping fluid into one end of the housing 34 to urge one end of the rain 32 out of the housing 34 to an extended position. Allowing the fluid out of the cylinder 12 allows the ram 32 to return to its original position, or another retracted position.

The supply line 18 supplies the fluid to the cylinder 12 when the cylinder 12 is actuated to extend the ram 32, and exhausts the fluid out of the cylinder 12 when the ram 32 is retracted. As shown in the fluid circuit 10 shown in FIG. 1, the supply line 18 has one end 36 connected to the cylinder 12 and an opposing end 38 in fluid communication with the multi-position control valve 26 of the control valve assembly 14.

Referring to FIGS. 1–8, the control valve assembly 14 controls the flow of fluid between the cylinder 12 and the reservoir 30, and includes the valve block assembly 19 having an upper valve block 21 and a lower valve block 22. The multi-position flow control valve 26 is mounted to the upper valve block 21 which is mounted to the lower valve block 22. Preferably, the valve block assembly 19 is formed from one or more solid pieces of material, such as metal.

The multi-position flow control valve 26 is mounted to the upper valve block 21, and includes three positions: a load position 46, a reset position 48, and an unload position 50. The multi-position flow control valve can 26 be operated manually, such as a rotary valve, electrically, such as by solenoids, and using fluids, such as hydraulically or pneumatically, without departing from the scope of the invention. Moreover, the multi-position flow control valve 26 can have any number of positions, such as only two, the load and unload positions, or more than three positions that control the flow of fluid to other cylinders, without departing from the scope of the invention.

The positions of the multi-position flow control valve 26 control the flow of fluid through the supply line 18 and passageways 44, 52, 54 in the lower valve block 22. In the load position 46, the multi-position flow control valve 26 directs fluid from a fluid supply passageway 44 formed in the lower valve block 22 into the supply line 18. In the reset position 48, the multi-position flow control valve 26 blocks fluid flow into and out of the supply line 18 and directs fluid from passageway 44 into fluid exhaust passageway 52. In the unload position 50, the multi-position flow control valve 26 directs fluid from the supply line 18 into fluid exhaust passageway 52 formed in the valve block assembly 19 and directs fluid from the fluid supply passageway 44 into a fluid bypass passageway 54.

The valve block assembly 19 defines portions of the supply line passageway, 23, the fluid supply passageway 44, the fluid exhaust passageway 52, and the fluid bypass passageway 54, as described below, which fluidly connect the pump 28 and cylinder 12 through the multi-position flow control valve 26 to quickly and efficiently actuate the cylinder 12. As described below, valves 40, 16 disposed in the supply line and fluid bypass passageways 23, 54, respectively, control the flow of fluid in response to the pressure in the fluid bypass passageway 54. Although a valve block assembly 19 formed from upper and lower valve blocks is shown, the valve block assembly can be formed from one or more valve blocks without departing from the scope of the invention. Moreover, the control valve assembly can be formed from fluidly connected individual components, such as individual components connected by hoses, without a valve block without departing from the scope of the invention.

The upper valve block 19 defines the supply line passageway 23 which forms a portion of the supply line 18 through the valve block assembly 19 to fluidly connect to the cylinder 12 to the multi-position control valve 26. A coupling 84 threadably engaging the valve block assembly 19, and in fluid communication with the supply line passageway 23 is adapted to couple with a fluid conduit, such as a pipe, hose, and the like, which is connected to the cylinder 12 to form another portion of the supply line 18. Preferably, the coupling 84 includes NPTF pipe threads to prevent fluid from leaking out of the passageway 23 past the coupling 84. Of course, other methods for sealing, such as O-rings, gaskets, and the like, can be provided to prevent fluid from leaking out of the passageway 23 past the coupling 84 without departing from the scope of the invention.

A pilot operated hold check valve 40 disposed in the portion of the supply line passageway 23 formed in the upper valve block 19 allows the fluid to flow toward the cylinder 12 and selectively prevents fluid from exhausting through the supply line 18. Advantageously, the check valve 40 maintains the pressure in the supply line 18 when fluid is not being supplied through the control valve assembly 14 and retraction of the ran 32 is not desired.

The check valve 40 includes a pilot line 42 that opens the check valve 40 when retraction of the ram 32 is desired. The pilot line 42 is in fluid communication with a fluid bypass passageway 54, and opens the check valve 40 when fluid pressure in the fluid bypass passageway 54 exceeds a predetermined level. Advantageously, the check valve 40 remains open until fluid flowing through the fluid bypass passageway 54 is blocked by the multi-position flow control valve 26.

The lower valve block 22 defines portions of the supply line passageway 23, the fluid supply passageway 44, the fluid exhaust passageway 52, and the fluid bypass passageway 54 which are in fluid communication with portions of the same passageways formed in the upper valve block 19. The passageways 23, 44, 52, 54 are formed in the lower valve block 22 using methods known in the art, such as drilling, boring, and the like, through the pieces. As described below, individual bores are interconnected to form each passageway 23, 44, 52, 54.

As shown in FIGS. 1 and 7–11, the lower valve block 22 is formed from upper and lower halves 56, 58 joined at internal interface surfaces 60, 62 to simplify assembly, and has a top surface 64 and a bottom surface 66 joined by sides 68. The top surface 64 includes an external interface surface 70 for fluidly connecting to one end of each passageway 44, 52, 54. Although splitting the lower valve block 22 into upper and lower halves 56, 58 is preferred, the lower valve block 22 can be formed from one or more pieces without departing from the scope of the invention.

The supply line passageway 23 is formed through the lower valve block 22, and includes an inlet end 73 and an exit end 75. Preferably, the supply line passageway 23 include a vertical shaft 95 extending from the external interface surface 70. A horizontal bore 96 formed from the side 68 of the valve block lower half 58 intersects the vertical shaft 95, and receives the coupling 84 for connecting to the cylinder 12. A cavity 80 surrounding the vertical shaft 95 and formed in the internal interface surface 60 of the upper half 56 can be provided for receiving an O-ring, or other type of seal. The O-ring prevents fluid from leaking from the supply line passageway 23 between the internal interface surfaces 60, 62 of the valve block upper and lower halves 56, 58.

The fluid supply passageway 44 is formed through the lower valve block 22, and includes an inlet end 72 and an exit end 74. The exit end 74 opens onto the external interface surface 70, and fluid flowing out of the exit end 74 is controlled by the multi-position flow control valve 26. Preferably, the fluid supply passageway 44 is formed by boring a vertical shaft 76 into the valve block halves 56, 58 from the external interface surface 70 through the lower valve block bottom 66.

The fluid bypass passageway 54 is also formed through the lower valve block 22, and includes an inlet end 90 and an exit end 92. The inlet end 90 opens onto the external interface surface 70, and fluid flowing into the inlet end 90 is controlled by the multi-position flow control valve 26. Preferably, the fluid bypass passageway 54 include a first angled bore 94 extending from the external interface surface 70. A horizontal bore 96 formed from the side 68 of the valve block upper half 56 intersects the angled bore 94 at an inner end 98 of horizontal bore 96, and receives the pilot operated relief valve 16. A second angled bore 100 opening onto the internal interface surface 60 of the valve block upper half 56 intersects the horizontal bore 96 a distance from the inner end 98 of the horizontal bore 96. A cavity 102 surrounding the second angled bore 100 and formed in the internal interface surface 60 of the upper half 56 can be provided for receiving an O-ring 104, or other type of seal. The O-ring 104 prevents fluid from leaking from the fluid bypass passageway 54 between the internal interface surfaces 60, 62 of the valve block upper and lower halves 56, 58.

A vertical shaft 106 formed in the valve block lower half 58 opens onto the internal interface surface 62 of the valve block lower half 58, and is in fluid communication with the second angled bore 100 formed in the valve block upper half 56. The vertical shaft 106 includes an inlet 108 opening onto the internal interface surface 62 and an opposing end 110. An angled bore 112 formed from the bottom surface 66 of the lower valve block 22 has one end 114 that intersects the vertical shaft 106. An opposing end 116 of the angled bore 112 opens to the valve block bottom surface 66, and is in fluid communication with the fluid reservoir 30 for exhausting fluid into the reservoir 30.

The fluid exhaust passageway 52 is also formed through the lower valve block 22, and include an inlet end 118 and an exit end 120. The inlet end 118 opens onto the external interface surface 70, and the outlet end 120 intersects the vertical shaft 106 of the fluid bypass passageway 54 proximal the is vertical bore opposing end 110. Advantageously, fluid flowing through the fluid bypass passageway 54 draws fluid through the fluid exhaust passageway 52.

The pilot operated relief valve 16 is received in the horizontal bore 96 of the fluid bypass passageway 54, and controls the flow of fluid through the fluid bypass passageway 54 between the external and internal interface surfaces 70, 60 of the valve block upper half 56. The pilot operated relief valve 16 can be any commercially available valve, such as available from Sun Hydraulics in Sarasota, Fla., which controls fluid flowing between a valve inlet 122 and outlet 124 in response to pressure in a pilot line 126 to maintain a pressure in the fluid bypass passageway 52, as required, to operate the pilot operated load hold check valve 40.

The valve inlet 122 is in fluid communication with the first angled bore 94 and the valve outlet 124 is in fluid communication with the second angled bore 100. The pilot operated relief valve 16 sealingly engages the inner surface of the horizontal bore 94 to prevent fluid from leaking past the valve 16 from the first angled bore 94 to the second angled bore 100 or out of the lower valve block 22 through the horizontal bore 94.

The pilot line 126 forms part of the pilot operated relief valve 16, and opens at the inlet 122 of the pilot operated relief valve 16 to sense the pressure of the fluid at the valve inlet 122. The pilot operated relief valve 16 opens (i.e. allows fluid to flow through the pilot operated relief valve between the valve inlet and valve outlet) when the pressure in the pilot line 126 exceeds a predetermined level. Preferably, the pilot operated relief valve 16 includes a "kick down" feature which maintains the relief valve 16 open once the pressure in the pilot line 126 exceeds the predetermined level, and the pilot operated relief valve 16 does not reset (i.e. blocks fluid flow through the pilot operated relief valve between the valve inlet and valve outlet) until flow through the fluid bypass passageway 54 is blocked by another valve, or other blockage.

The venturi nozzle 24 is received in the fluid bypass passageway vertical shaft 76, and draws fluid through the fluid exhaust passageway 52 into the fluid bypass passageway 54 which exhausts the fluid into the reservoir 30. The venturi nozzle 24 has an inlet end 128 proximal the inlet 108 of the vertical shaft 106 and an outlet end 130 proximal the outlet 110 of the vertical shaft 106. Fluid flowing through the fluid bypass passageway 54 enters the venturi nozzle 24 through the venturi nozzle inlet end 128 and exits the venturi nozzle 24 through the venturi nozzle outlet end 130 to lower the pressure in the fluid exhaust passageway 52 intersecting the fluid bypass passageway 54 proximal the venturi nozzle outlet end 130 to draw fluid in the fluid exhaust passageway 52 into the fluid bypass passageway 54.

In use, the cylinder 12 is actuated by moving the multi-position flow control valve 26 to the load position 46 and actuating the pump 28. The pump 28 pumps the fluid from the reservoir 30, through the fluid supply passageway 44 in the lower valve block 22, through the multi-position flow control valve 26, and past the pilot operated load hold check valve 40 into the supply line 18. The pumped fluid flows into the cylinder housing 34 to urge the ram 32 to the extended position.

Extension of the ram 32 is halted by turning off the pump 28 to stop the flow of fluid through the fluid supply passageway 44. Although the pilot operated load hold check valve 40 prevents fluid from unintentionally exhausting from the cylinder 12 through the supply line 18, preferably, the multi-position flow control valve 26 is moved to the reset position 48 to prevent fluid from flowing in reverse through the fluid supply passageway 44 into the pump exhaust port.

The ram 32 is retracted back into the cylinder housing 34 by turning on the pump 28 and shifting the multi-position flow control valve 26 to the unload position. The pump 28 pumps fluid from the reservoir 30 into the fluid supply passageway 44, through the multi-position flow control valve 26, and into the fluid bypass passageway 54. The pilot operated relief valve 16 blocks the flow of fluid in the fluid bypass passageway 54 which causes the pressure in the fluid bypass passageway 54 to rise. Once the pressure in the fluid bypass passageway 54, and thus the pilot line 42 forming part of the pilot operated load hold check valve 40, reaches the predetermined operating level of the pilot operated load hold check valve 40, the check valve 40 opens to allow fluid in the cylinder 12 and supply line 18 to flow through the multi-position flow control valve 26 and into the fluid exhaust passageway 52. Once the pilot operated load hold check valve 40 opens, and the pressure in pilot line 126 forming part of the pilot operated relief valve 16 reaches the predetermined operating level of the pilot operated relief valve 16 which is higher than the predetermined operating level of the pilot operated load hold check valve 40, the pilot operated relief valve 16 opens to relieve the pressure in the fluid bypass passageway 54 and allow the fluid pumped into the fluid supply passageway 44 to flow through the venturi nozzle 24 to draw fluid through the fluid exhaust passageway 52 and out of the cylinder 12. Advantageously, both the load hold check valve 40 and relief valve 16 remain open until the flow of the fluid through the valves 16, 40 stops regardless of the pressure in the fluid bypass passageway 54.

The load hold check valve 40 and relief valve 16 are reset (i.e. closed to block fluid flow) by moving the multi-position flow control valve 26 to the reset position 48 which blocks fluid from flowing through the load hold check valve 40 and the relief valve 16. Advantageously, in the reset position 48, the multi-position flow control valve 26 directs fluid being pumped by the pump 28 into the fluid supply passageway 44 into the fluid exhaust passageway 52 which exhausts into the fluid bypass passageway 54 downstream of the venturi nozzle 24 and back into the reservoir 30 to avoid pressure from building up in the lower valve block 22 and connecting conduits connecting the pump 28 to the lower valve block 22. Of course, the pump 28 can be turned off when the multi-position flow control valve 26 is in the reset position 48 to prevent pressure from building up in the lower valve block 22 and connecting conduits connecting the pump 28 to the lower valve block 22.

While there has been shown and described what are at present considered the preferred embodiment of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention.

We claim:

1. A fluid flow control valve assembly comprising:

a valve body having a fluid supply passageway, a fluid exhaust passageway, and a fluid bypass passageway;

a venturi nozzle disposed in said fluid bypass passageway, and having an upstream end and a downstream end, wherein said fluid exhaust passageway intersects said fluid bypass passageway proximal said downstream end of said venturi nozzle such that fluid flowing through said venturi nozzle lowers the pressure in said fluid exhaust passageway; and a pilot operated relief valve disposed in said fluid bypass passageway, wherein said pilot operated relief valve blocks said fluid bypass passageway to create a pressure upstream of said pilot operated relief valve to actuate a different pilot operated device having a pilot line in fluid communication with said fluid bypass passageway upstream of said pilot operated relief valve.

2. The fluid flow control valve assembly as in claim 1, in which said pilot operated relief valve is disposed in said fluid bypass passageway upstream of said venturi nozzle, and said pilot operated relief valve opens to allow fluid to flow through said venturi nozzle upon fluid pressure upstream of said pilot operated relief valve exceeding a predetermined level.

3. The fluid flow control valve assembly as in claim 1, in which said valve body is formed from at least two parts, wherein said venturi nozzle is disposed in one of said parts and said pilot operated relief valve is disposed in another of said parts.

4. The fluid flow control valve assembly as in claim 1, in which said body includes an interface surface, and said fluid supply passageway includes a exit end opening onto said interface surface, said fluid exhaust passageway includes an inlet end opening onto said interface surface, and said fluid bypass passageway includes an inlet opening onto said interface surface.

5. The fluid flow control valve assembly as in claim 1, including a multi-position control valve controlling the flow of fluid through a supply line, wherein in a load position, said fluid supply passageway is in fluid communication with said supply line to supply fluid to said supply line, in a reset position, fluid flow through supply line and said fluid bypass passageway is blocked, and in an unload position, said fluid supply passageway is in fluid communication with said fluid bypass passageway upstream of said pilot operated relief valve and said fluid exhaust passageway is in fluid communication with said supply line, wherein fluid flowing through said fluid supply passageway is directed through said pilot operated relief valve and into said venturi nozzle through said venturi inlet to draw fluid out of said supply line through said fluid exhaust passageway.

6. The fluid flow control valve assembly as in claim 5, in which said different pilot operated device having a pilot line is a pilot operated load hold check valve having a pilot line in fluid communication with said fluid bypass passageway, wherein when said multi-position control valve is in said unload position, said load hold check valve blocks fluid from flowing out of said supply line until fluid pressure in said check valve pilot line is greater than a predetermined level.

7. The fluid flow control valve assembly as in claim 6, in which said pilot operated relief valve includes a pilot line in fluid communication with said fluid bypass passageway upstream of said pilot operated relief valve, wherein said pilot operated relief valve opens upon a fluid pressure in said pilot line of said pilot operated relief valve reaching a predetermined level, and said predetermined level of fluid pressure in said pilot line of said pilot operated load hold check valve is less than said predetermined level of fluid pressure in said pilot line of said pilot operated relief valve, such that said pilot operated load hold check valve opens before said pilot operated relief valve.

8. A fluid flow control valve assembly for controlling fluid flow through a supply line to a cylinder, said fluid control valve assembly comprising:

a valve body having a fluid supply passageway, a fluid exhaust passageway, and a fluid bypass passageway;

a pilot operated load hold check valve disposed in the supply line, and having a pilot line in fluid communication with said fluid bypass passageway, wherein when a multi-position control valve is in an unload position, said load hold check valve blocks fluid from flowing out of said supply line until fluid pressure in said check valve pilot line is greater than a predetermined level;

a pilot operated relief valve disposed in said fluid bypass passageway, wherein said pilot operated relief valve blocks said fluid bypass passageway to create a pressure upstream of said pilot operated relief valve to actuate said pilot operated load hold check valve and said pilot operated relief valve opens one the fluid pressure in said check valve pilot line is greater than the predetermined level, and said pilot operated relief valve does not close until fluid flow through said fluid bypass passageway is blocked; and said multi-position control valve controlling the flow of fluid through the supply line, wherein in a load position, said fluid supply passageway is in fluid communication with said supply line to supply fluid to said supply line, in a reset position, fluid flow through the supply line and said fluid bypass passageway is blocked, and in an unload position, said fluid supply passageway is in fluid communication with said fluid bypass passageway upstream of said pilot operated relief valve and said fluid exhaust passageway is in fluid communication with the supply line, wherein fluid flowing through said fluid supply passageway is directed through said pilot operated relief valve.

9. The fluid flow control valve assembly as in claim 8, including a venturi nozzle disposed in said fluid bypass passageway, and having an upstream end and a downstream end, wherein said fluid exhaust passageway intersects said fluid bypass passageway proximal said downstream end of said venturi nozzle such that fluid flowing through said venturi nozzle lowers the pressure in said fluid exhaust passageway, wherein in said unload position of said multi-position control valve fluid flowing through said fluid supply passageway is directed through said pilot operated relief valve and into said venturi nozzle through said venturi inlet to draw fluid out of the supply line through said fluid exhaust passageway.

10. The fluid flow control valve assembly as in claim 9, in which said pilot operated relief valve is disposed in said fluid bypass passageway upstream of said venturi nozzle, and said pilot operated relief valve opens to allow fluid to flow through said venturi nozzle upon fluid pressure upstream of said pilot operated relief valve exceeding a predetermined level.

11. The fluid flow control valve assembly as in claim 8, in which said valve body is formed from at least two parts, wherein said venturi nozzle is disposed in one of said parts and said pilot operated relief valve is disposed in another of said parts.

12. The fluid flow control valve assembly as in claim 8, in which said body includes an interface surface, and said fluid supply passageway includes a exit end opening onto said interface surface, said fluid exhaust passageway includes an inlet end opening onto said interface surface, and said fluid bypass passageway includes an inlet opening onto said interface surface.

13. The fluid flow control valve assembly as in claim 8, in which said pilot operated relief valve includes a pilot line in fluid communication with said fluid bypass passageway upstream of said pilot operated relief valve, wherein said pilot operated relief valve opens upon a fluid pressure in said pilot line of said pilot operated relief valve reaching a predetermined level, and said predetermined level of fluid pressure in said pilot line of said pilot operated load hold check valve is less than said predetermined level of fluid pressure in said pilot line of said pilot operated relief valve, such that said pilot operated load hold check valve opens before said pilot operated relief valve.

14. A fluid flow control valve assembly for controlling fluid flow through a supply line to a cylinder, said fluid control valve assembly comprising:

a valve body having a fluid supply passageway, a fluid exhaust passageway, and a fluid bypass passageway;

a pilot operated load hold check valve disposed in the supply line, and having a pilot line in fluid communication with said fluid bypass passageway, wherein when a multi-position control valve is in said unload position, said load hold check valve blocks fluid from flowing out of said supply line until fluid pressure in said check valve pilot line is greater than a predetermined level;

a pilot operated relief valve disposed in said fluid bypass passageway, wherein said pilot operated relief valve blocks said fluid bypass passageway to create a pressure upstream of said pilot operated relief valve to actuate said pilot operated load hold check valve;

said multi-position control valve controlling the flow of fluid through the supply line, wherein in a load position, said fluid supply passageway is in fluid communication with the supply line to supply fluid to said supply line, in a reset position, fluid flow through the supply line and said fluid bypass passageway is blocked, and in an unload position, said fluid supply passageway is in fluid communication with said fluid bypass passageway upstream of said pilot operated relief valve and said fluid exhaust passageway is in fluid communication with the supply line, wherein fluid flowing through said fluid supply passageway is directed through said pilot operated relief valve; and a venturi nozzle disposed in said fluid bypass passageway, and having an upstream end and a downstream end, wherein said fluid exhaust passageway intersects said fluid bypass passageway proximal said downstream end of said venturi nozzle such that fluid flowing through said venturi nozzle lowers the pressure in said fluid exhaust passageway, wherein in said unload position of said multi-position control valve fluid flowing through said fluid supply passageway is directed through said pilot operated relief valve and into said venturi nozzle through said venturi inlet to draw fluid out of the supply line through said fluid exhaust passageway.

15. The fluid flow control valve assembly as in claim 14, in which said pilot operated relief valve is disposed in said fluid bypass passageway upstream of said venturi nozzle, and said pilot operated relief valve opens to allow fluid to flow through said venturi nozzle upon fluid pressure upstream of said pilot operated relief valve exceeding a predetermined level.

16. The fluid flow control valve assembly as in claim 14, in which said valve body is formed from at least two parts, wherein said venturi nozzle is disposed in one of said parts and said pilot operated relief valve is disposed in another of said parts.

17. The fluid flow control valve assembly as in claim 14, in which said body includes an interface surface, and said fluid supply passageway includes a exit end opening onto said interface surface, said fluid exhaust passageway includes an inlet end opening onto said interface surface, and said fluid bypass passageway includes an inlet opening onto said interface surface.

18. The fluid flow control valve assembly as in claim 14, in which said pilot operated relief valve includes a pilot line in fluid communication with said fluid bypass passageway upstream of said pilot operated relief valve, wherein said pilot operated relief valve opens upon a fluid pressure in said pilot line of said pilot operated relief valve reaching a predetermined level, and said predetermined level of fluid pressure in said pilot line of said pilot operated load hold check valve is less than said predetermined level of fluid pressure in said pilot line of said pilot operated relief valve, such that said pilot operated load hold check valve opens before said pilot operated relief valve.

* * * * *

UNITED STATES PATENT AND TRADEMARK OFFICE

CERTIFICATE OF CORRECTION

PATENT NO. : 6,899,012 B2
DATED : May 31, 2005
INVENTOR(S) : Pili et al.

It is certified that error appears in the above-identified patent and that said Letters Patent is hereby corrected as shown below:

Column 4,
Line 48, “ran” should be changed to -- ram --.

Column 9,
Line 19, “one” should be changed to -- once --.

Signed and Sealed this

Twenty-seventh Day of September, 2005

JON W. DUDAS
*Director of the United States Patent and Trademark Office*